US008421355B2

(12) United States Patent
Miyamura et al.

(10) Patent No.: US 8,421,355 B2
(45) Date of Patent: Apr. 16, 2013

(54) PLASMA TUBE ARRAY-TYPE DISPLAY DEVICE

(75) Inventors: Yukiharu Miyamura, Kobe (JP); Koji Shinohe, Kobe (JP); Katsuhiko Itamasu, Kobe (JP)

(73) Assignee: Shinoda Plasma Co., Ltd., Kobe (JP)

( * ) Notice: Subject to any disclaimer, the term of this patent is extended or adjusted under 35 U.S.C. 154(b) by 0 days.

(21) Appl. No.: 13/290,506

(22) Filed: Nov. 7, 2011

(65) Prior Publication Data

US 2012/0139411 A1 Jun. 7, 2012

(30) Foreign Application Priority Data

Dec. 7, 2010 (JP) ..... 2010-272366

(51) Int. Cl.
*H01J 17/49* (2006.01)

(52) U.S. Cl.
USPC ..... 313/582; 313/292

(58) Field of Classification Search ..... 313/582–587, 313/292

See application file for complete search history.

(56) References Cited

U.S. PATENT DOCUMENTS

| | | | | |
|---|---|---|---|---|
| 5,971,566 | A | 10/1999 | Tani et al. | |
| 7,342,792 | B2 * | 3/2008 | Kim et al. | 361/704 |
| 2009/0315441 | A1 | 12/2009 | Shinohe et al. | |

FOREIGN PATENT DOCUMENTS

| | | |
|---|---|---|
| JP | 2002-202729 | 7/2002 |
| JP | 2010-27598 | 2/2010 |

* cited by examiner

*Primary Examiner* — Nimeshkumar Patel
(74) *Attorney, Agent, or Firm* — Staas & Halsey LLP

(57) ABSTRACT

In a plasma tube array-type display device, a first surface of the intermediate member, which is a flexible and bumpy intermediate member 4 interposed between a plasma tube array and a frame substrate, is attached with the rear surface of the plasma tube array at a top face of a plurality of convex portions provided on the first surface, and a second surface opposite to the first surface is attached with the frame substrate so as to define a screen shape, thereby the plasma tube array can be separated easily from the frame substrate.

16 Claims, 6 Drawing Sheets

PLASMA TUBE ARRAY-TYPE DISPLAY DEVICE

CROSS REFERENCE TO RELATED APPLICATION

This application claims the benefit under 35 U.S.C. §119 (a) of Japanese Application No. 2010-272366, filed Dec. 7, 2010, in the Japanese Patent Office, the disclosure of which are hereby incorporated by reference.

BACKGROUND OF THE INVENTION

1. Field of the Invention

The present invention relates to a plasma tube array-type display device including a plurality of plasma tubes arranged in parallel. Particularly, the present invention relates to a plasma tube array-type display device wherein a plasma tube array and a frame substrate are attached to each other with a bumpy intermediate member.

2. Description of the Related Art

As disclosed in US Pub. No. 2009/0315441A1 (JP2010-27598A), a plasma tube array-type display device in which a plurality of plasma tubes (light-emitting tubes) filled with a discharge gas are arranged in parallel has been developed as a new-generation large-screen display devices. For example, a plasma tube array-type display device in which a plurality of one meter square plasma tube array modules are connected to one another can be used to construct a large-screen display device with a size of several meters by several meters. In the case of the plasma tube array-type display device, it is not necessary to handle a large glass substrate and no large-scale equipment is required as in the case of, for example, LCDs and PDPs. Therefore, the large-screen display device with uniform image quality can be provided at a lower cost.

In FIG. 6A, the plasma tube array 30 of the conventional plasma tube array-type display device has a rectangular shape and includes a plurality of plasma tubes 31, 31, . . . arranged in parallel, each of which is filled with a discharge gas. Each of the plasma tubes 31, 31, . . . is made of a thin glass tube. The diameter of each tube is desirably about 0.5 to 5 mm. Each thin plasma tube may have any shape of cross-section, such as a circular cross-section, oblate ellipsoid cross-section, or square cross-section. Furthermore, the plasma tubes 31, 31, . . . are filled with a discharge gas mixture such as neon, xenon and the like at a predetermined ratio and a predetermined pressure.

The plurality of plasma tubes 31, 31, . . . arranged in parallel are held between a rear-side address electrode sheet 33 and a front-side display electrode sheet 35. The rear-side address electrode sheet 33 comprises address electrodes 32, 32, . . . provided to be in contact with the lower surface in the longitudinal direction of each plasma tube 31. The front-side display electrode sheet 35 comprises display electrodes 34, 34, . . . provided in the direction crossing the upper surface in the longitudinal direction of each plasma tube 31. The display electrode sheet 35 is a flexible sheet and is configured with, for example, a polycarbonate film or a PET (polyethylene terephthalate) film.

A plurality of display electrodes 34, 34, . . . are provided in a stripe pattern on the inner surface of the display electrode sheet 35. They are in contact with each plasma tube 31 in such a manner as to cross the upper surface thereof. Adjacent display electrodes 34 and 34 configuring a display electrode pair serve as an X electrode and a Y electrode, and a display discharge is generated inside the plasma tubes 31, 31, . . . between the X electrode and the Y electrode. The display electrodes 34 can be formed to permit the light transmission in a pattern known in the present field, such as a mesh pattern, a ladder pattern, or a comb teeth pattern, in addition to a transparent stripe pattern. Furthermore, examples of the material that is used for the display electrodes 34 include transparent conductive materials such as ITO (indium tin oxide) and $SnO_2$ and metal conductive materials such as Ag, Au, Al, Cu, and Cr.

Various methods known in the present field can be used for the method of forming the display electrodes 34. For example, they may be formed using a thick-film forming technique such as printing or may be formed using a thin-film forming technique, which includes a physical deposition method or a chemical deposition method, and a patterning technique of photolithography. One example of the thick-film forming techniques is a screen printing method. Among the thin-film forming techniques, examples of the physical deposition method include a vapor deposition method and a sputtering method. Examples of the chemical deposition method include a thermal CVD method, a photo-CVD method, and a plasma CVD method.

The address electrodes 32, 32, . . . each are provided per plasma tube 31 on the rear face of the plasma tube array 30 along the longitudinal direction of the plasma tubes 31, 31, . . . . The address electrodes 32, 32, . . . form discharge cells (light-emitting cells) at intersections with the paired display electrodes 34, 34, . . . . The address electrodes 32 also can be formed using various materials and methods that are known in the present field. The address electrode sheet 33 on which the address electrodes 32, 32, . . . are formed is shown as one sheet for convenience. Actually, however, it is configured with a plurality of separated sheets, each of which corresponds to, for example, one RGB set of three plasma tubes 31 or eight RGB sets of 24 plasma tubes 31, from the viewpoints of cancelling the position errors between the plasma tubes 31 and the address electrodes 32 caused by slight differences in diameter between the respective plasma tubes 31 and obtaining flexibility of the display screen in the direction intersecting with the longitudinal direction of the plasma tubes 31.

As shown in FIG. 6B, each plasma tube 31 comprises a red (R) phosphor layer 36R, a green (G) phosphor layer 36G, or a blue (B) phosphor layer 36B. When one pixel is configured with one set of the discharge cells in plasma tubes 31, 31, and 31 of three colors RGB, the plasma tube array 30 can serve as a color display. In the case of the red (R) phosphor layer 36R, a phosphor material such as (Y, Gd) $BO_3$:$Eu^{3+}$ that emits red light by ultraviolet irradiation is used for the phosphor layer 36. In the case of the green (G) phosphor layer 36G, a phosphor material such as $Zn_2$ $SiO_4$:Mn that emits green light is used, while in the case of the blue (B) phosphor layer 36B, a phosphor material such as $BaMgAl_{12}O_{17}$:$Eu^{2+}$ that emits blue light is used.

FIG. 6C is a perspective view that schematically shows a plasma tube array-type display device 45 in which the plasma tube array sub-modules 10 are connected to one another in a matrix. In FIG. 6C, one plasma tube array-type display device 45 for a large screen is composed of four plasma tube array sub-modules 10, 10, . . . . The drive circuit and the power supply circuit are incorporated for the combined large screen as one display device 45. This makes it possible to configure a large-screen display device with less variations in quality of display images among the plasma tube array sub-modules 10, 10, . . . . The plasma tube array sub-modules 10 and 10 connected laterally can commonly be driven by connecting their display electrodes 34 and 34 to each other. With respect to the plasma tube array sub-modules 10 and 10 connected vertically to each other, the address electrodes 32 and 32 of each of them are independently led out to the upper end and lower end of the screens, and each terminal of the upper-side and lower-side address electrodes is connected to an address drive circuit (not shown) respectively. The screen of the two upper-side plasma tube array sub-modules 10 and 10 and the screen of the two lower-side plasma tube array sub-modules 10 and 10 can be driven in parallel by a known addressing method so-called "dual scan technique".

PRIOR ART DOCUMENTS

Patent Documents

[Patent Document 1] US Pub. No. 2009/031544A1 (JP2010-27598A)

[Patent Document 2] U.S. Pat. No. 5,971,566 (JP3499849B)

SUMMARY OF THE INVENTION

As described above, the plasma tube array 30 itself is configured with plasma tubes 31, 31, . . . held between the address electrode sheet 33 and the display electrode sheet 35, which are flexible sheets. Therefore, it is difficult to maintain the screen shape without any support. Accordingly, the plasma tube array 30 is attached to the rigid frame substrate to form the plasma tube array-type display device or sub-module 10.

However, in the construction of which the plasma tube array 30 and the frame substrate are attached directly to each other, it is difficult to separate the plasma tube array 30 from the frame substrate for repairs or replacement of the plasma tubes. The rip off-force is exerted on the plasma tube array 30 and thereby the plasma tubes 31 are broken or the frame substrate is damaged, which has been a problem. Moreover, when the plasma tube array 30 and the frame substrate are attached to each other while being misaligned with each other, the plasma tube array 30 and the frame substrate cannot be reused, which also has been a problem.

Moreover, the surface of the frame substrate generally has irregularities caused by deformation, flaws, or an uneven application of an adhesive. Therefore, the plasma tube array 30 attached directly to frame substrate is deformed along the irregularities of the surface of the frame substrate. As a result, the needless force corresponding to the irregularity projection of the surface is exerted on the plasma tubes 31, thereby failure is caused in light emission of the plasma tubes 31. Furthermore, since the plasma tube array 30 and the frame substrate are attached directly to each other, impact delivered from outside on the frame substrate may propagate directly to the plasma tube array 30 to damage the plasma tubes 31.

The present invention has been made with the above circumstances in view and it is an object thereof to provide a plasma tube array-type display device, wherein a plasma tube array can be separated easily from a frame substrate, and unnecessary force or impact delivered from the frame substrate can be buffered. In short, future of this invention is that a flexible and bumpy member or sheet (intermediate member) is interposed between a plasma tube array and a rigid substrate (frame substrate). The bumpy member has a first surface including a plurality of convex portions adhered with rear side surface of the plasma tube array and a second surface adhered with rigid rear substrate.

More concretely, in order to achieve the above-mentioned objects, a plasma tube array-type display device according to a first invention comprises a plasma tube array that includes a plurality of plasma tubes filled with a discharge gas and arranged in parallel and that holds the plurality of plasma tubes between an address electrode sheet with address electrodes formed thereon and a display electrode sheet with display electrodes formed thereon, a frame substrate that supports a rear side of the plasma tube array and defines the shape of a display screen, and an intermediate member that is flexible and that attaches the rear side of the plasma tube array to the frame substrate, wherein the intermediate member has a plurality of convex portions at the surface to be attached to the rear side of the plasma tube array.

In the first invention, the rear side of the plasma tube array and the frame substrate are attached to each other not directly but with the intermediate member, which has a plurality of convex portions at the surface to be attached to the rear side of the plasma tube array, being interposed therebetween. That is, the plasma tube array is partially attached at only top surfaces of the convex portions with intermediate member. Therefore, the plasma tube array can be separated easily from the frame substrate. A plasma tube array-type display device according to a second invention is characterized in that in the first invention, the intermediate member supports less than ten of the plasma tubes with one of the convex portions.

In the second invention, since one of the convex portions supports less than ten of the plasma tubes, the area where the respective convex portions of the intermediate member are attached to the rear side of the plasma tube array is reduced and therefore it becomes easier to remove the plasma tube array from the intermediate member. Thus, the plasma tube array can be separated more easily from the frame substrate.

Furthermore, a plasma tube array-type display device according to a third invention is characterized in that in the first or second invention, the intermediate member bonds the convex portions to the rear side of the plasma tube array with a first adhesive or a first double-sided adhesive tape while the intermediate member bonds the opposite surface to that having the convex portions to the frame substrate with a second adhesive or a second double-sided adhesive tape.

Furthermore, a plasma tube array-type display device according to a fourth invention is characterized in that in the third invention, the first adhesive or the first double-sided adhesive tape has a weaker adhesive strength than that of the second adhesive or the second double-sided adhesive tape.

A plasma tube array-type display device according to a fifth invention is characterized in that in first or second inventions, the intermediate member has a plurality of concave portions at the opposite surface to that having the convex portions.

In the fifth invention, the whole surface of the intermediate member is not attached to the frame substrate but the surface of the excluding the concave portions is attached to the frame substrate. Thus, the area where the intermediate member is attached to the frame substrate is reduced and thereby it becomes easier to remove the frame substrate from the intermediate member.

Furthermore, a plasma tube array-type display device according to a sixth invention is characterized in that in the fifth invention, the intermediate member is provided with a cutting thread for cutting the convex portions or the adhesion portions between the rear side of the plasma tube array and the convex potions in order to separate the plasma tube array from the frame substrate.

In the sixth invention, it is not necessary to prepare a tool for separating the plasma tube array from the frame substrate. The plasma tube array can be separated easily from the frame substrate by pulling the cutting thread to cut the convex portions or the adhesion portions between the rear side of the plasma tube array and the convex portions.

Furthermore, a plasma tube array-type display device according to a seventh invention is characterized in that in the fifth invention, the convex portion of the intermediate member has a slit provided at side wall in parallel with the plasma tube array.

In the seventh invention, the convex portions can be cutoff easily from the slits. Thus, it is not necessary to prepare a tool for separating the plasma tube array from the frame substrate.

According to the above-mentioned configurations, the plasma tube array-type display device comprises the flexible intermediate member or sheet for attaching the rear side of the plasma tube array and the frame substrate. Since the intermediate member has a plurality of convex portions at the surface to be attached to the rear side of the plasma tube array, the plasma tube array can be separated easily from the frame substrate. Furthermore, even when the surface of the frame substrate has irregularities caused by deformation, flaws, or an uneven application of an adhesive, the intermediate member or sheet can absorb such irregularities and prevent the deform of the plasma tube due to the surface irregularities of the frame substrate. Moreover, since the flexible intermediate member has a shock absorbing function due to the convex potion, impact delivered from outside on the frame substrate can be buffered by the intermediate member.

BEST MODE FOR CARRYING OUT THE INVENTION

Hereinafter, embodiments of the present invention are described in detail with reference to the drawings.

<Embodiment 1>

Figure 1:
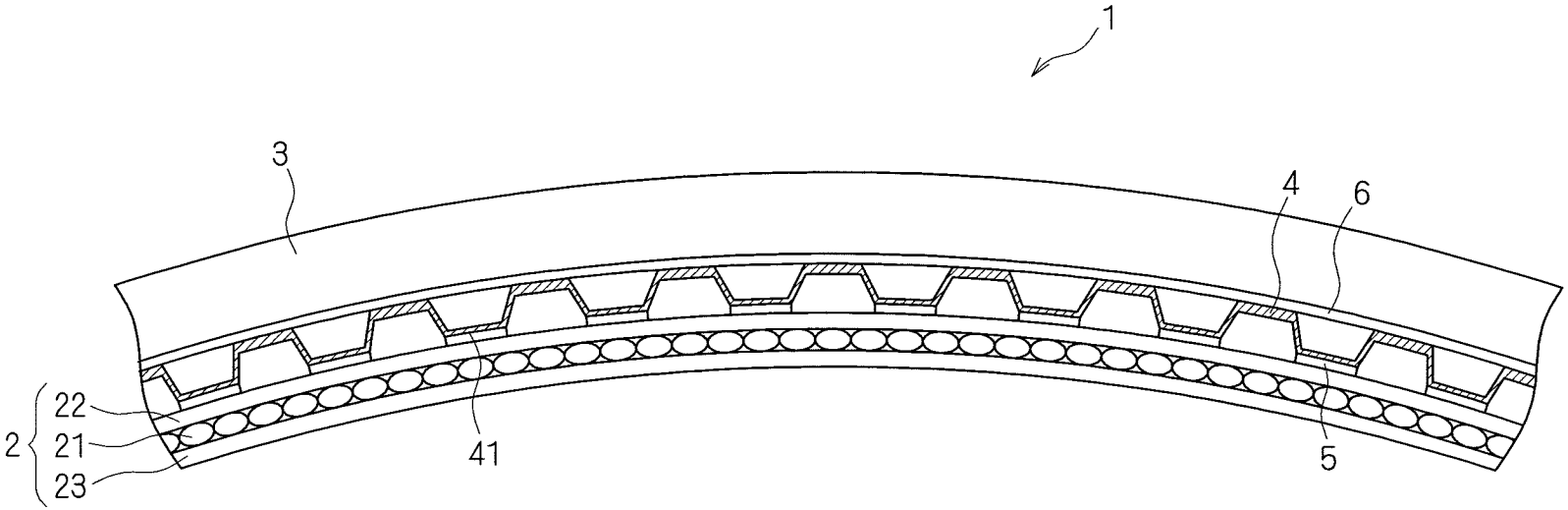
FIG. 1 is a cross-sectional view showing a configuration of a plasma tube array-type display device according to Embodiment 1 of the present invention.

The plasma tube array-type display device 1 shown in FIG. 1 comprises a plasma tube array 2 that includes a plurality of plasma tubes 21, 21, . . . filled with a discharge gas and arranged in parallel. The plurality of plasma tubes 21, 21, . . . is held between an address electrode sheet (rear sheet) 22 has address electrodes formed thereon, and a display electrode sheet (front sheet) 23 has display electrodes formed thereon. A frame substrate 3 is provided on the rear side of the plasma tube array 2 and has a function to define the shape of a display screen. Further, a flexible and bumpy intermediate member 4 which characterizes the present invention is interposed between the rear side of the plasma tube array 2 and the frame substrate 3.

Figure 6C:
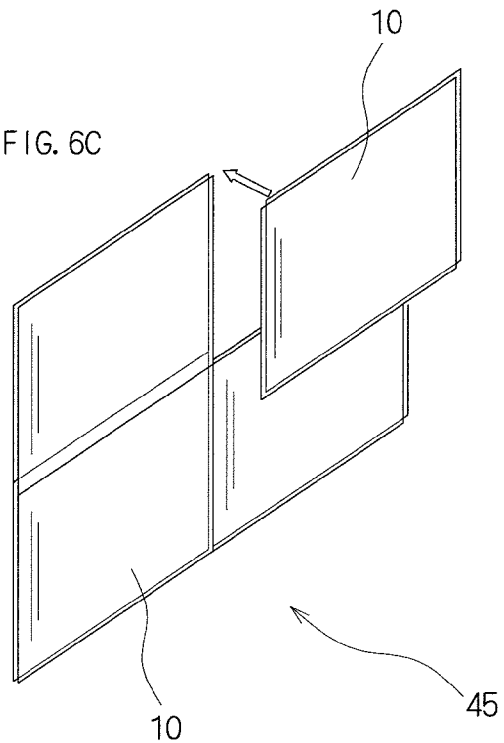
FIGS. 6A, 6B, and 6C are perspective views that schematically show the configuration of a plasma tube array of a conventional plasma tube array-type display device.
Figure 6A:
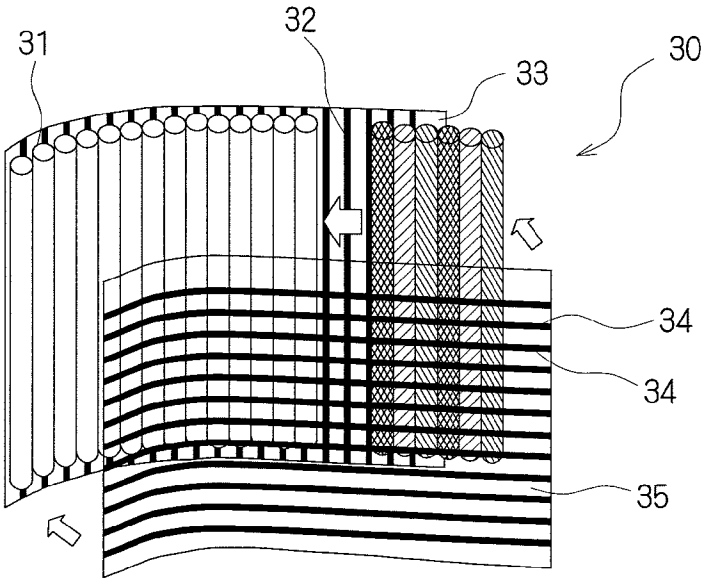
Figure 6B:
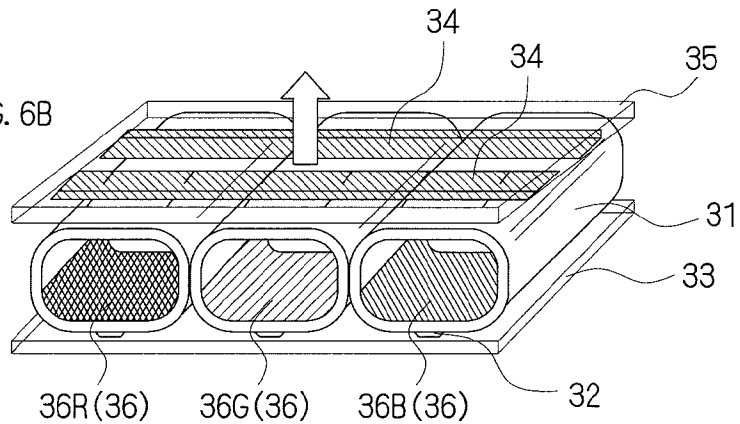

The plasma tube array 2 has substantially the same configuration as that of the plasma tube array 30 shown in FIGS. 6A and 6B. Therefore, the detailed descriptions thereof are not repeated.

The frame substrate 3 is a plate or board formed using, for example, aluminum or carbon-reinforced resin, to be attached to the plasma tube array 2. The frame substrate 3 has a function of defining the screen shape of the flexible plasma tube array 2. In the case of FIG. 1, the frame substrate has a shape curved in such a manner that the surface to be attached to the rear side of the plasma tube array 2 is a concave surface as a whole. The flexible and bumpy intermediate member (buffer sheet) 4 is formed using, for example, a thin silicon resin film with a hardness of 12 or less, preferably approximately 8 to 5, so as to be flexible. Furthermore, the intermediate member 4 has a plurality of convex portions 41 at the first surface to be attached to the address electrode sheet 22 (the rear side of the plasma tube array 2) of the plasma tube array 2. The rear side of the plasma tube array 2 and the frame substrate 3 are attached to each other not directly but with the intermediate member 4. The bumpy intermediate member 4 has a plurality of convex portions 41 at the first surface to be attached to the address electrode sheet 22 of the plasma tube array 2. Since an adhered area between intermediate member and plasma tube array 2 is limited only on the top faces of the convex portions of the intermediate member, the plasma tube array 2 can be separated easily from the frame substrate 3.

Figure 2A:
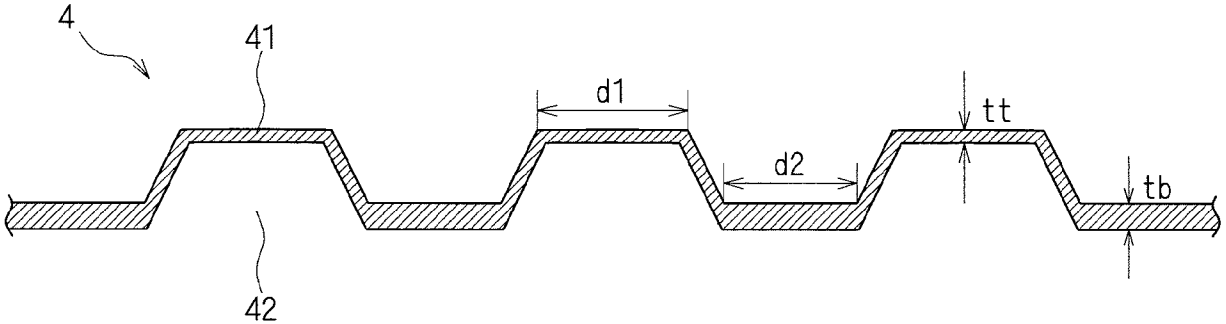
FIGS. 2A and 2B are schematic views showing a configuration of an intermediate sheet of the plasma tube array-type display device according to Embodiment 1 of the present invention.
Figure 2B:
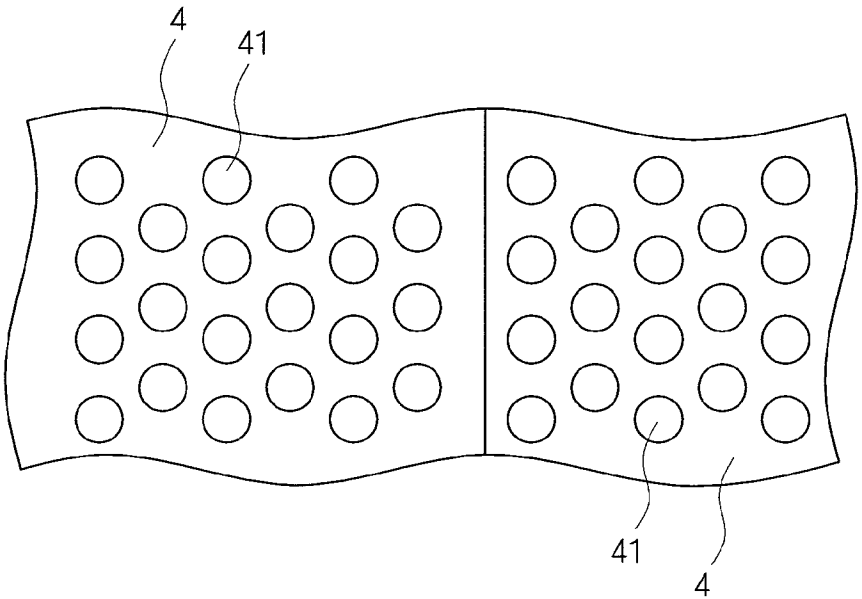

FIGS. 2A and 2B are schematic views showing a configuration of the intermediate member 4 of the plasma tube array-type display device 1 according to Embodiment 1 of the present invention. As shown in the cross-sectional view in FIG. 2A, the intermediate member 4 has a second surface including a plurality of concave portions 42 corresponding to the positions of the convex portions 41 at the first surface to that having the convex portions 41. Therefore, the whole of the second surface of the intermediate sheet 4 is not attached to the frame substrate 3 but only the second surface of the intermediate member 4 excluding the concave portions 42 is partially attached to the frame substrate 3. Thus, the area where the intermediate member 4 is adhered to the frame substrate 3 is reduced and thereby it becomes easier to remove the frame substrate 3 from the intermediate member 4.

The size d1 in the lateral direction of each top face (top portion) of the convex portions 41 of the intermediate member 4 is approximately the same as the size d2 between adjacent convex portions 41 of the intermediate sheet 4 and is less than 10 mm that corresponds to the total tube diameter of ten plasma tubes 21. When the plasma tube 21 has a diameter of 1 mm, the intermediate member 4 supports less than ten of the plasma tubes 21 with one of the convex portions 41. Therefore, the area where the respective convex portions 41 of the intermediate member 4 are attached to the address electrode sheet 22 of the plasma tube array 2 is reduced and thereby it becomes easier to remove the plasma tube array 2 from the intermediate sheet 4. Thus, the plasma tube array 2 can be separated more easily from the frame substrate 3.

Furthermore, in the intermediate member 4, the thickness tb of the base portions (bottom portions) excluding the convex portions 41 is thicker than the thickness tt of the top surfaces (top portions) of the convex portions 41. For example, the thickness tt of the top portions is 0.1 mm to 0.5 mm and the thickness tb of the base portions is 0.5 mm to 1.0 mm.

As shown in the plan view in FIG. 2B, the convex portions 41 of the intermediate member 4 each has a circular shape in planar view. That is, the convex portions 41 of the intermediate member 4 each have a conical frustum shape. However, the shape of each convex portion 41 of the intermediate member 4 in planar view is not limited to the circular shape and may be another shape such as a triangular shape, a rectangular shape, or a polygonal shape. Furthermore, the shape of each convex portion 41 of the intermediate member 4 is not limited to a frustum shape and may be a columnar shape.

The scattered arrangement of the convex portions 41 provided at the first surface to be attached to the address electrode sheet 22 of the intermediate member 4 is not limited to regularly staggered arrangement as shown in FIG. 2B and may be random arrangement. However, evenly scattered arrangement of the convex portions is preferable in view of supporting whole area of the plasma tube array uniformly. Furthermore, the convex portions 41 of the intermediate member 4 are not limited to have the same shape in all in planar view and can have different shapes, respectively.

From the viewpoint of workability, it is preferable that the intermediate member 4 is configured with one sheet with respect to one module of the plasma tube array 2. However, as shown in FIG. 2B, a plurality of separated bumpy sheets may be arranged to be adjoined to each other. For example, with respect to the plasma tube array 2 of one meter square, the intermediate member 4 can be configured with 100 inexpensive small bumpy sheets of ten centimeter square attached to one another in a matrix to form the whole.

The intermediate member 4 bonds the top surface of the convex portions 41 to the address electrode sheet 22 with the adhesive 5, and the opposite surface to that having the convex portions 41 to the frame substrate 3 with the adhesive 6. The rear side of the plasma tube array 2 and the frame substrate 3 can be attached to each other, with the intermediate member 4 being interposed therebetween. In this connection, a double-sided adhesive tape may be used instead of the adhesives 5 or 6. That is, the convex portions 41 and the address electrode sheet 22 may be bonded with an adhesive while the opposite surface to that having the convex portions 41 and the frame substrate 3 may be bonded with the double-sided adhesive tape. Further, the convex portions 41 and the address electrode sheet 22 may be bonded with the double-sided adhesive tape while the opposite surface to that having the convex portions 41 and the frame substrate 3 may be bonded with the adhesive. Moreover, when the intermediate sheet 4 itself is formed of an adhesive material, the adhesive or the double-sided adhesive tape is not required.

The adhesive 5 (first adhesive) or the double-sided adhesive tape (first double-sided adhesive tape) for bonding the convex portions 41 and the address electrode sheet 22 may be the same as or different from the adhesive 6 (second adhesive) or the double-sided adhesive tape (second double-sided adhesive tape) for bonding the opposite surface to that having the convex portions 41 and the frame substrate 3. However, it is preferable that the first adhesive 5 or the first double-sided adhesive tape for bonding the convex portions 41 and the address electrode sheet 22 has a weaker adhesive strength than that of the second adhesive 6 or the second double-sided adhesive tape for bonding the opposite surface to that having the convex portions 41 and the frame substrate 3. In that construction, the plasma tube array 2 can be separated from the frame substrate 3 without excessive force being applied to.

As described above, in the plasma tube array-type display device 1 according to Embodiment 1 of the present invention the plasma tube array 2 can be separated easily from the frame substrate 3. Therefore, even when the plasma tube array 2 and the frame substrate 3 are attached to each other while being misaligned with each other, once the plasma tube array 2 and the frame substrate 3 can be separated and remounted correctly. Further, in the case of replacing the plasma tube array 2 which is broken, the time required for replacement can be reduced. Furthermore, as described above, when the address electrode sheet 22 is configured with a plurality of separated sheets, each of which corresponds to, for example, eight RGB sets of 24 plasma tubes 21, it also is possible to replace a faulty plasma tube 21 by separating it from the display electrode sheet 23 in a unit of the address electrode sheet 22 containing it from the plasma tube array 2 separated from the frame substrate 3. In the plasma tube array-type display device 1 according to Embodiment 1 of the present invention, the intermediate member 4 is not limited to be attached directly to the address electrode sheet 22 of the plasma tube array 2 and may be attached to the address electrode sheet 22 of the plasma tube array 2, with another film, which has, for example, a light reflection function or an electromagnetic shielding function, being interposed therebetween.

Furthermore, the rear side of the plasma tube array 2 and the frame substrate 3 are attached to each other, with the flexible and bumpy intermediate member 4 being interposed therebetween. Therefore, even when the surface of the frame substrate 3 has irregularities caused by deformation, flaws, or an uneven application of an adhesive, the intermediate member 4 can prevent the plasma tube array 2 from being deformed due to the irregularities of the frame substrate 3 to reduce the force that is exerted on the plasma tubes 21 and thereby light emission failure of the plasma tubes 21 can be prevented from occurring. Moreover, since the rear side of the plasma tube array 2 and the frame substrate 3 are attached to each other, with the flexible intermediate member being interposed therebetween, impact exerted on the frame substrate 3 can be buffered by the intermediate sheet 4 and does not propagate directly to the plasma tube array 2, and thereby the possibility of damaging the plasma tubes 21 can be reduced. Furthermore, the intermediate member 4 can inhibit the plasma tube array 2 from vibrating and thereby can effectively inhibit abnormal noise that the plasma tube array 2 generates.

In FIG. 1, the plasma tube array 2 attached to the frame substrate 3, with the intermediate member 4 being interposed therebetween, is described as a plasma tube array-type display device 1. However, the plasma tube array 2 attached to the frame substrate 3, with the intermediate member 4 being interposed therebetween, can be constructed as one sub-module or unit. With a plurality of sub-modules described above being connected to one another in a matrix, a plasma tube array-type display device for a large screen can be configured.

Figure 3:
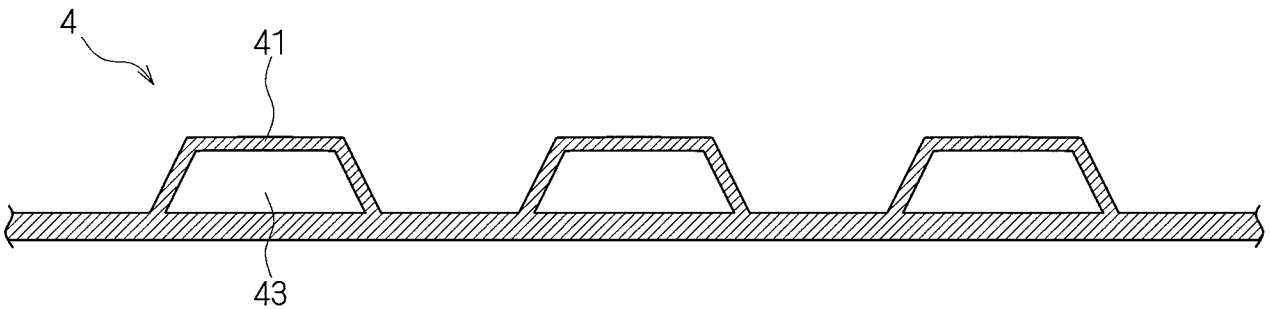
FIG. 3 is a cross-sectional view showing another configuration of the intermediate sheet of the plasma tube array-type display device according to Embodiment 1 of the present invention.

Moreover, the shape of the intermediate member 4 is not limited to that having a plurality of concave portions 42 at the opposite surface to that having the convex portions 41 as shown in FIG. 2A and may be a shape having a space inside of each convex portion 41 at the opposite surface to that having the convex portions 41. FIG. 3 is a cross-sectional view showing another configuration of the intermediate member 4. The intermediate member 4 shown in FIG. 3 has a shape in which the opposite surface to that having the convex portions 41 is a flat surface and each convex portion 41 has a space 43 therein, with the space 43 being filled with, for example, a liquid, gel, or air.

<Embodiment 2>

Figure 4:
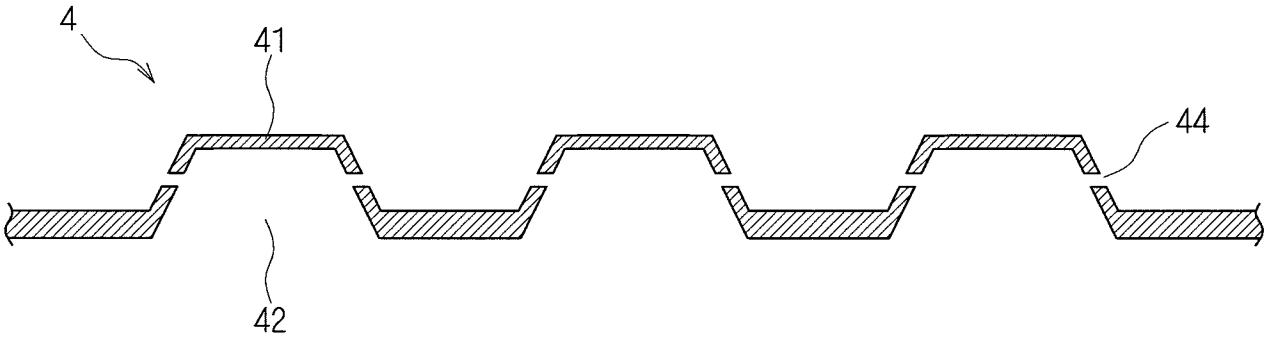
FIG. 4 is a cross-sectional view showing a configuration of an intermediate sheet of a plasma tube array-type display device according to Embodiment 2 of the present invention.

FIG. 4 is a cross-sectional view showing a configuration of an intermediate member 4 of a plasma tube array-type display device 1 according to Embodiment 2 of the present invention. Since the plasma tube array-type display device 1 according to Embodiment 2 of the present invention has the same configuration except for the configuration of the intermediate member 4, the detailed descriptions are not repeated.

The intermediate member 4 shown in FIG. 4 has a plurality of convex portions 41 at the surface to be attached to the address electrode sheet 22 of the plasma tube array 2 (the rear side of the plasma tube array 2) and a plurality of concave portions 42 corresponding to the positions of the convex portions 41 at the opposite surface to that having the convex portions 41. Furthermore, the convex portions 41 of the intermediate member 4 have a plurality of slits provided in parallel with the plasma tube array 2. Therefore, when force is applied to the direction in which the plasma tube array 2 is removed from the frame substrate 3, the convex portions 41 can be cutoff easily from the slits 44.

<Embodiment 3>

Figure 5A:
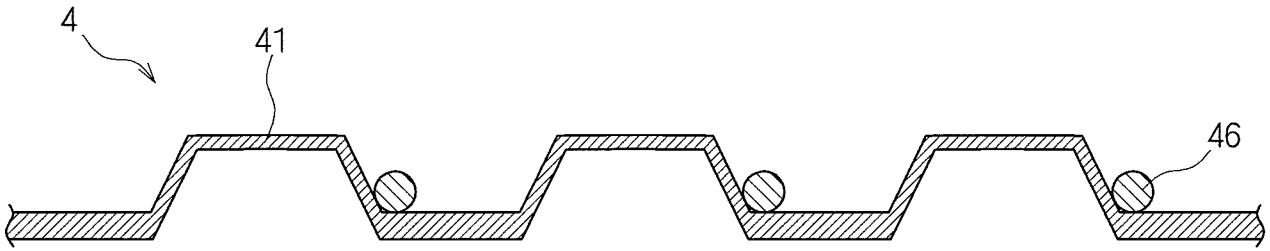
FIGS. 5A and 5B are schematic views showing a configuration of an intermediate sheet of a plasma tube array-type display device according to Embodiment 3 of the present invention.
Figure 5B:
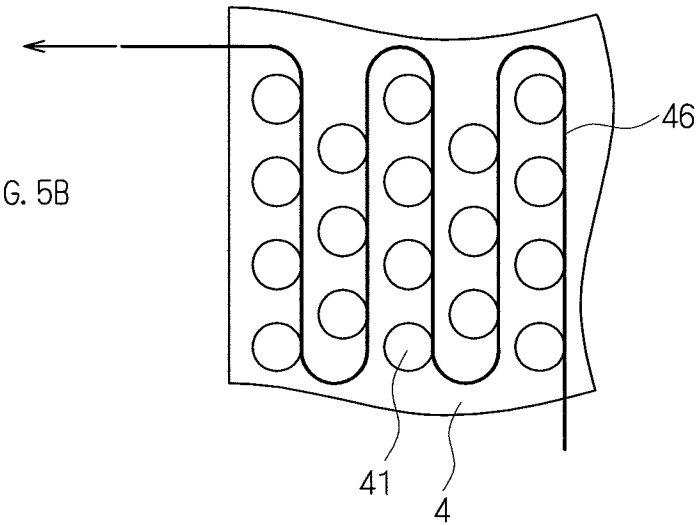

FIGS. 5A and 5B are schematic views showing a configuration of an intermediate sheet 4 of a plasma tube array-type display device 1 according to Embodiment 3 of the present invention. As shown in the cross-sectional view in FIG. 5A, the intermediate member 4 is provided with a cutting thread 46 for cutting the convex portions 41 or the adhesion portions between the address electrode sheet 22 of the plasma tube array 2 (the rear side of the plasma tube array 2) and the convex potions 41 in order to separate the plasma tube array 2 from the frame substrate 3. The cutting thread 46 is provided in the vicinity of each convex portion 41. Furthermore, as shown in the plan view in FIG. 5B, the cutting thread 46 is one thread extended along the arrangement of the convex portions 41.

When the plasma tube array 2 is to be separated from the frame substrate 3, an end of the cutting thread 46 provided in the vicinity of each convex portion 41 is pulled in the direction of the arrow, which results in cutting the convex portions 41 or the adhesion portions between the address electrode sheet 22 of the plasma tube array 2 and the convex portions 41. As in the case above, when the intermediate member 4 provided with the cutting thread 46 in the vicinity of the convex portions 41, the cutting thread 46 can be used to cutoff the convex portions 41 more easily to separate the plasma tube array 2 from the frame substrate 3. The material of the cutting thread 46 may be, for example, fiber, resin, or metal as long as it has enough strength to cutoff the convex portions 41 or the adhesion portions between the address electrode sheet 22 of the plasma tube array 2 and the convex portions 41.

What is claimed is:

1. A plasma tube array-type display device, comprising:

a plasma tube array that includes a plurality of plasma tubes filled with a discharge gas and arranged in parallel and that holds the plurality of plasma tubes between an address electrode sheet with address electrodes formed thereon and a display electrode sheet with display electrodes formed thereon, a frame substrate that supports a rear side of the plasma tube array and defines the shape of a display screen, and an intermediate member that is flexible and interposed between the plasma tube array and the frame substrate, wherein the intermediate member has a plurality of convex portions at the surface to be attached to the rear side of the plasma tube array, and further comprising:

a first adhesive bonding a top face of each of the convex portions to the rear side of the plasma tube array, and a second adhesive bonding an opposite face of the intermediate member to the frame substrate.

2. The plasma tube array-type display device according to claim 1, wherein the convex portions are arranged in scattered arrangement and each of which has a width in a lateral direction of the top face corresponding to a total tube diameter of less than ten of the plasma tubes.

3. The plasma tube array-type display device according to claim 1, wherein a first bonding strength between the rear side of the plasma tube array and the intermediate member is weaker than a second bonding strength between the intermediate member and the frame substrate.

4. The plasma tube array-type display device according to claim 2, wherein a first bonding strength between the rear side of the plasma tube array and the intermediate member is weaker than a second bonding strength between the intermediate member and the frame substrate.

5. The plasma tube array-type display device according to claim 1, wherein the first adhesive has a weaker adhesive strength than that of the second adhesive.

6. The plasma tube array-type display device according to claim 2, wherein the first adhesive has a weaker adhesive strength than that of the second adhesive.

7. The plasma tube array-type display device according to claim 1, wherein the intermediate member has a plurality of concave portions at the opposite surface to that having the convex portions.

8. The plasma tube array-type display device according to claim 2, wherein the intermediate member has a plurality of concave portions at the opposite surface to that having the convex portions.

9. The plasma tube array-type display device according to claim 5, wherein the intermediate member has a plurality of concave portions at the opposite surface to that having the convex portions.

10. The plasma tube array-type display device according to claim 6, wherein the intermediate member has a plurality of concave portions at the opposite surface to that having the convex portions.

11. The plasma tube array-type display device according to claim 1, wherein the intermediate member is provided with a cutting thread for cutting the convex portions or adhesion portions between the rear side of the plasma tube array and the convex potions in order to separate the plasma tube array from the frame substrate.

12. The plasma tube array-type display device according to claim 1, wherein each of the convex portions of the intermediate member has a slit provided in parallel with the plasma tube array for cutoff.

13. A plasma tube array-type display device comprising:

a plasma tube array including a plurality of plasma tubes arranged in parallel and supported between a front sheet and a rear sheet;

a rigid substrate provided on a rear side of the plasma tube array to define a shape of a screen of the plasma tube array;

an intermediate member made of flexible resin film having a first surface which includes a plurality of convex portions and a second surface which includes a plurality of concave portions at positions corresponding to the convex portions;

wherein the first surface of the intermediate member being adhered with the rear side of the plasma tube array on a top face of the convex portions, and the second surface of the intermediate member being adhered with the rigid substrate on a base portion excepting the concave portions.

14. The plasma tube array-type display device according to claim 13, wherein the intermediate member is made of a silicon resin film with a thickness in a range of 0.1 mm to 1 mm.

15. The plasma tube array-type display device according to claim 14, wherein the thickness of the top face portion of the convex portion is thinner than the thickness of the base portion of the intermediate member.

16. A plasma tube array-type display device, comprising:

a plasma tube array including a plurality of plasma tubes arranged in parallel;

a frame substrate provided on a rear side of the plasma tube array, and a flexible buffer sheet interposed between the plasma tube array and the frame substrate and having a first surface which includes a plurality of convex portions arranged in scattered arrangement and a second surface which includes a plurality of concave portions at positions corresponding to the positions of the convex portions, wherein the first surface of the flexible buffer sheet is adhered with the rear side of the plasma tube array on a top face of the convex portions by a first adhesive or a first double-sided adhesive tape, and the second surface of the flexible buffer sheet is adhered with the frame substrate on a base portion accepting the concave portions by a second adhesive or a second double-sided adhesive tape.

* * * * *